United States Patent [19]

Johnson

[11] Patent Number: 4,787,830

[45] Date of Patent: Nov. 29, 1988

[54] RESILIENT DIESEL GOVERNOR COUPLING

[75] Inventor: Rayburn Johnson, 10860 Elderwood Rd., San Diego, Calif. 92131

[73] Assignees: Rayburn Johnson; William Loud, both of San Diego, Calif.

[21] Appl. No.: 85,144

[22] Filed: Aug. 14, 1987

[51] Int. Cl.[4] ..... F04B 29/00; F02M 41/00

[52] U.S. Cl. ..... 417/462; 123/449; 123/450

[58] Field of Search ..... 417/294, 462; 123/449, 123/450

[56] References Cited

U.S. PATENT DOCUMENTS

| | | | |
|---|---|---|---|
| 2,641,238 | 6/1953 | Roosa | 123/450 |
| 4,255,291 | 9/1980 | Bouwkamp et al. | 417/462 |
| 4,453,522 | 6/1984 | Salzgeer | 417/462 |

*Primary Examiner*—William L. Freeh

*Attorney, Agent, or Firm*—Brown, Martin, Haller & Meador

[57] ABSTRACT

A coupling device for use in diesel fuel injector pumps having a plurality of rotary pumps connected to a drive shaft and positioned in a housing along a longitudinal axis and having a generally cylindrical weight retention housing for rotatably supporting a plurality of fly-weights which are coupled to a fuel control system. The coupling device employs an annular drive ring adjacent to the weight housing for engaging the drive shaft and a plurality of drive pins connected to the weight housing and projecting through elongated apertures in the drive ring. A plurality of resilient inserts are positioned within the elongated apertures immediately adjacent to the drive pins so as to occupy substantially all aperture volume not occupied by the pins. An annular capture ring dimensioned to reside in a depression on a a back surface of the drive ring is connected to the drive pins, which do not extend beyond the back surface of the drive ring, and captures the resilient inserts between the weight housing and the capture ring.

6 Claims, 2 Drawing Sheets

RESILIENT DIESEL GOVERNOR COUPLING

BACKGROUND OF THE INVENTION

1. Field of the Invention

The present invention relates to diesel engines and more particularly to a flexible governor coupling device for use in fuel injector pumps for diesel engines utilizing urethane coupling rings. The invention further relates to a resilient coupling having self confined, high temperature, fuel resistant flexure members.

2. Background of the Art

Diesel engines have been incorporated in a wide variety of motor vehicles including passenger cars and light trucks for many years. Diesel engines have found greater use in recent years because of the advantages of the basic engine design including, lower cost fuels, greater fuel efficiency, lack of complicated wiring and electronic fueling systems, etc. To a great extent diesel engines for use in commercial and heavy duty vehicles have been designed or engineered over time and have performed well.

However, many diesel engines, especially the lighter vehicle versions, have been plagued with problems in recent years. These engines have undergone failures ranging from a simple loss of power to a catastrophic failure of the entire fuel system. These problems have often been attributed to poor design characteristics for the engine as a whole but are not readily understood due to the wide variations in the manifested damage and no post damage analysis by repair facilities.

Diesel engines operate using a close approximation to the Carnot thermodynamic cycle as opposed to the Otto cycle employed by conventional gasoline engines. A diesel engine compresses air in the cylinders to much higher pressures so that the air achieves ignition temperatures for the fuel. The fuel is then injected directly into the cylinders where it is combusted and drives the cylinders. Therefore, no spark plugs are required for this combustion process.

Diesel engines use high pressure multi-staged fuel pumps to inject the fuel directly into the cylinders at the higher cylinder pressures. Since diesel engines function as compression fired systems, there is no spark advance or retard mechanism as in gasoline engines. This function is replaced by the timing of the fuel injection into the cylinders. Therefore, fuel injectors provide two major functions for engine operation. The control of fuel flow rate and the timing of fuel entry.

It has been discovered, however, that fuel flow and timing mechanisms in some fuel injector pumps have design flaws that are responsible in great part for the aforementioned engine failures. This is seen principally in a class of injector pumps produced by the Roosa Master Company of Hartford, Conn. which employs a flexible coupling ring assembly between a rotating governor mechanism and a main injector pump drive shaft. This coupling assembly has been found to have a high rate of failure.

When the flexible coupling for the governor fails, major or even catastrophic damage may result. Such damage occurs because the coupling ring material segments into very small pieces that become lodged in fuel lines and high pressure rotary fuel pump stages creating abnormally high pressures within the pump. This causes severe damage to these parts and any high pressure seals or membranes encountered. This leads to fuel system leaks and general failure. Even if the damage is limited, replacing the coupling ring assembly and associated parts with an assembly of the same design simply creates a probability that the same problem will occur again with potentially more serious results.

What is needed then is a method of constructing or repairing the governor drive linkage so that system failure is avoided and the life span of both the fuel injector pump and the engine are extended. Such a method or apparatus has eluded the prior art developers before the present invention. The prior art solution has been to either periodically rebuild damaged injector pumps or change the engine design to incorporate different governor devices or fuel injector pumps at great expense and not correct problems with existing engines nor take advantage of existing engine development.

SUMMARY

With the above problems and disadvantages of the art in mind it is an object of the present invention to provide a new governor coupling device for the Roosa Master type diesel fuel injector pumps which has a greatly increased life span.

It is an advantage that the linkage of the present invention can be either retroactively fitted in existing engines or installed in new engines.

It is another advantage of the present invention that it does not damage the fuel injector pump even in failure modes.

These and other objects, advantages, and purposes of the present invention are realized in a fuel governor coupling device for use in diesel fuel injector pump systems having a main housing for confining a plurality of rotary pumps positioned in series along a longitudinal axis and being connected through a drive shaft to an engine power source. The governor employs a generally cylindrical weight housing positioned adjacent to the rotary pumps with a central opening for passage of the drive shaft and a series of recesses about its circumference for rotatably supporting a plurality of flyweights which are connected to a fuel control system. The coupling device comprises an annular drive ring with at least one key extending from a central opening for interlocking with the drive shaft, a plurality of elongated apertures extending between two opposing surfaces at predetermined radial and angular positions about the ring and an annular depression centrally located on one surface between an outer edge and an inner edge. A plurality of drive pins, corresponding in number to the elongated apertures are mounted on one end to the governor weight housing and extend through the drive plate apertures where they are secured to a capture ring resting in the annular depression. The drive pins have a diameter slightly smaller than the width of the apertures to allow freedom of motion therein. A plurality of resilient inserts positioned immediately adjacent to the drive pins occupy substantially all aperture volume not occupied by the drive pins.

BRIEF DESCRIPTION OF THE DRAWINGS

The novel features of the present invention may be better understood from the accompanying description when taken in conjunction with the accompanying drawings in which like characters refer to like parts and in which.

DETAILED DESCRIPTION OF A PREFERRED EMBODIMENT

The present invention comprises a resilient or flexible governor coupling device for use in fuel system injector pumps for diesel engines especially of the type manufactured by the Roosa Master Company of Hartford, Conn. The governor linkage or coupling device of the present invention has a long life expectancy and accommodates operational stresses in an improved manner. This is accomplished in a resilient coupling device by using a diesel fuel resistant and resilient material disposed within recesses in a drive ring which connects to a flyweight housing through interaction between the resilient material and a series of drive pins secured to the weight housing. The resilient material is held within the recesses by a capture ring.

Figure 1:
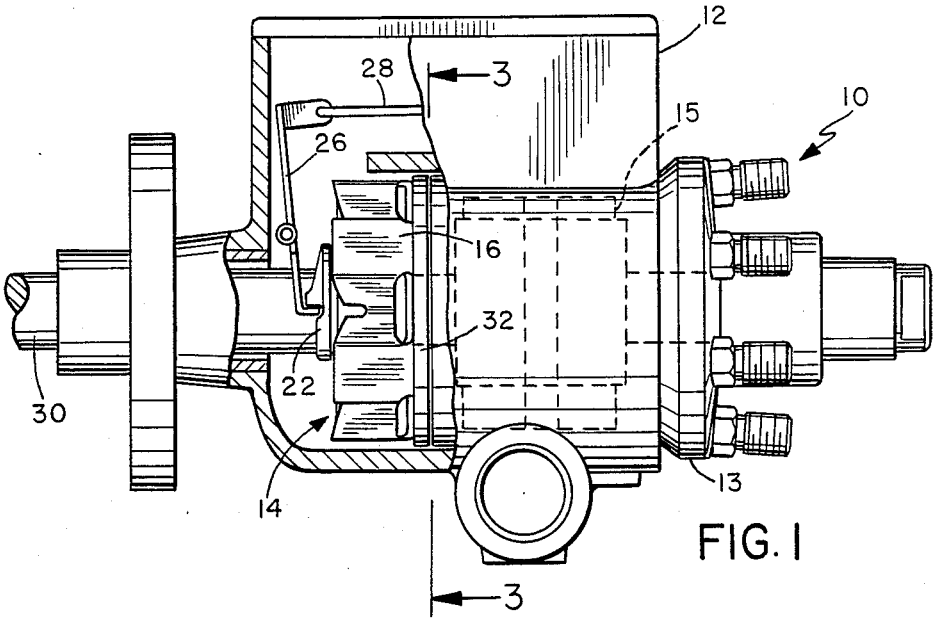
FIG. 1 illustrates a side elevation of a typical fuel injector pump for a diesel engine, partially cut away to show the governor mechanism.

A typical fuel injector pump for diesel engines is illustrated in FIG. 1 where part of an external housing 12 is cut away to show the positioning of a governor 14 relative to a main rotary pump body 13 containing one or more rotary vanes of pistons 15. In the typical fuel injector 10, the governor 14 has a generally cylindrical weight housing 16 which contains a series of flyweights 18 which readjust their relative position within the enclosure 16 depending upon the rate of rotation for the governor 14.

Figure 4:
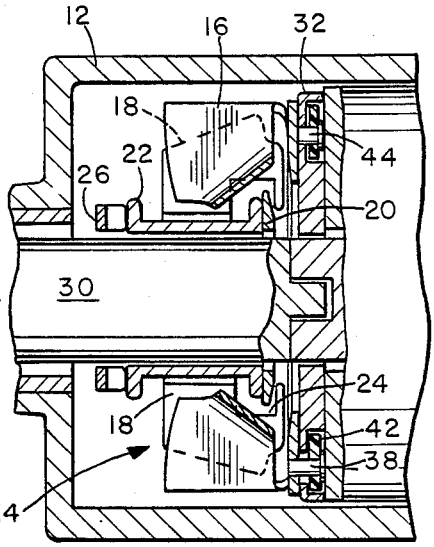
FIG. 4 PRIOR ART
FIG. 4 is a sectional view taken along line 4—4 of FIG. 3 and rotated by 90 degrees.

The mechanical interaction of the weights 18 is better seen from the sectional view through the prior art governor as illustrated in FIG. 4. In FIG. 4, the weights 18 support a collar 22 on a ring 20 in lower weight slots 24. The bottom of the weights 18 are curved and as the upper portion of the weights are forced toward an outer edge of the enclosure 16 by centrifugal force, the inner bottom edge of the weights pivot upward and press against the ring 20 and the collar 22. This action presses the collar 22 against the lever arm 26.

Returning for the moment to FIG. 1, the lever arm 26 connects through a linkage arm 28 to various fuel flow adjustment means (not shown) in a remaining part of the housing 12. Therefore, variations in rotational speed of the governor 14 enclosure 16 causes positional variations in the flyweights 18 which varies the height of the weight slots 24. This in turn alters the position of the collar 22, lever arm 26 and linkage 28, all of which alter the flow of fuel into high pressure pumping stages of the injector pump 10.

The rotational drive for the governor 14 is provided by a rotating drive the rotary vanes or piston 15 in the shaft 30 which is used to drive high pressure pumping stages of the fuel injector pump 10. The governor 14 has a central passage through which the shaft extends and about which the governor 14 rotates. The governor is not directly connected to the shaft 30 as this would lead to severe operating problems.

At or near idle speeds, the rapid cylinder pressure rise of a diesel engine and extremely high compression ratio, as evidenced by an idle "knock", tends to produce sharp pulses of acceleration and deceleration which are transferred from the engine through the drive shaft 30. Coupling between the shaft 30 and the governor 14 needs to be flexible or have a degree of elasticity or pliability to accommodate any sudden pulse transferred to the fuel timing and pumping mechanism. Otherwise, the governor weights and the retainer housing will be damaged. Therefore, a resilient or flexible linkage is provided between the weight weight retainer 16 and the shaft 30. The prior are method and apparatus for this linkage is illustrated in more detail in the bottom view of FIG. 3.

Figure 3:
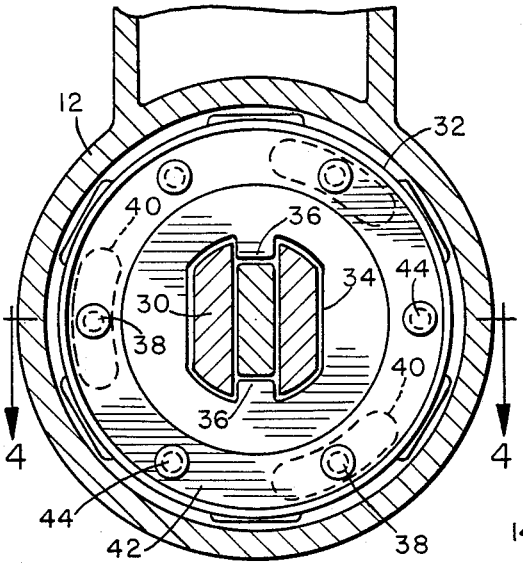
FIG. 3 PRIOR ART
FIG. 3 is a sectional view taken along line 3—3 of FIG. 1, showing the prior art flexible coupling device.

In FIG. 3, a drive plate or ring 32 has a central opening 34 for fitting over the shaft 30 with two or more keys 36. The keys 36 engage slots in the drive shaft 30 to connect the drive ring 32 to the shaft 30 for rotation. A series of drive pins 38 are attached to the enclosure 16 and extend through slots 40 in the drive ring 32 where they attach to a flex ring 42. The pins 38 are typically attached to the enclosure 16 using a base portion that is inserted into matching holes in the enclosure 16 during manufacture and expanded like rivets. Alternatively, the pins can be spot welded or otherwise fastened in place. The pins 38 typically have a flared top which captures the flex ring 42 against the drive ring 32.

To transfer driving power from the drive ring 32 to the enclosure 16, a second series of pins 44 are secured directly to the drive ring 32 and extend through the flex ring 42. The pins 44 are typically attached by pressed fitting into matching holes in the drive ring 32.

Therefore, as the drive ring 32 rotates it transfers power to the flex ring 42 which in turn transfers power to the drive pins 38 and the governor enclosure 16. This transfer of rotational power, thus means the rotation of the flyweight assembly and the aforedescribed regulation of fuel flow and timing.

However, the flex ring 42 suffers from several incorrect design assumptions. First, the ring generally comprises urethane which is known in the art as being resistant to the corrosive effects of diesel fuel, which is known to be highly destructive to many materials. However, it has been discovered that at the elevated temperatures experienced by the injector pump of a diesel engine, the urethane does decay or otherwise break down over a relatively short period of time.

The combination of diesel fuel and high temperature reacts with the urethane over a relatively short period of time to make the material brittle. Typically the amount of failure time corresponds to the period of time required for an average diesel powered truck or car to be driven a maximum of about 40,000 miles. The rate of flex ring degradation will vary according to the driving conditions but it is a certain process.

The second design problem is that the flex ring transfers power by tension exerted across the ring material between the pins 38 and 44. This type of force tends to fatigue the urethane structure over a relatively short period of time leading to part failure.

The two processes described combine to generate high failure rates at relatively low engine mileages or life spans. When the flex ring 42 fails it generally becomes segmented into small pieces that break off. These pieces are free to travel into the remaining portion of the injector pump 10 housing and enter high pressure pumps which are quickly damaged as previously described.

In the present invention, these problems are solved by changing the manner of construction and operation for the resilient coupling used between the drive ring 32 and the governor enclosure 16. Instead of allowing a continuous ring of material, inserts of material are formed and placed in the slots 40 previously used only to accommodate the pins 38.

Figure 2:
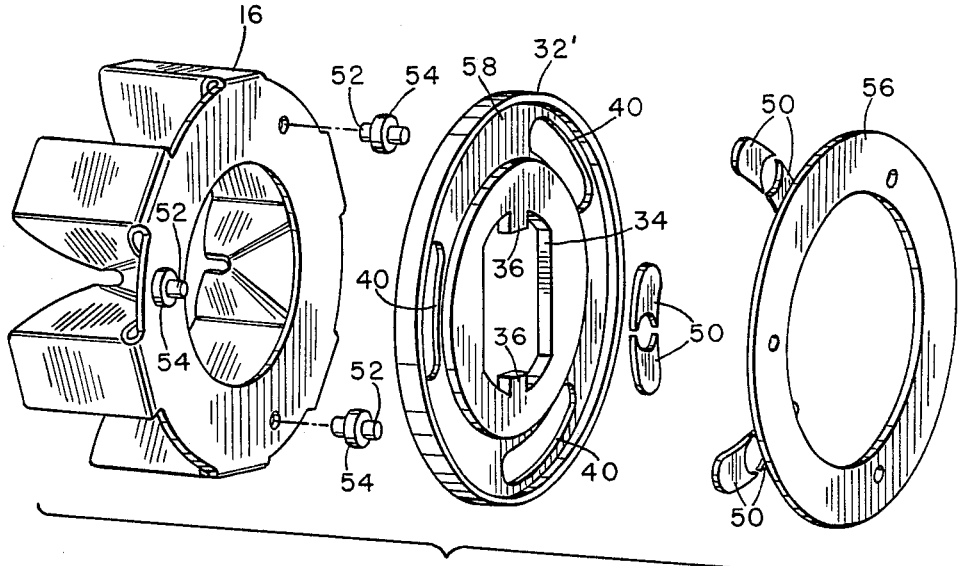
FIG. 2 illustrates an exploded perspective view of the components of a flexible linkage device for a governor, constructed according to the principles of the present invention.
Figure 5:
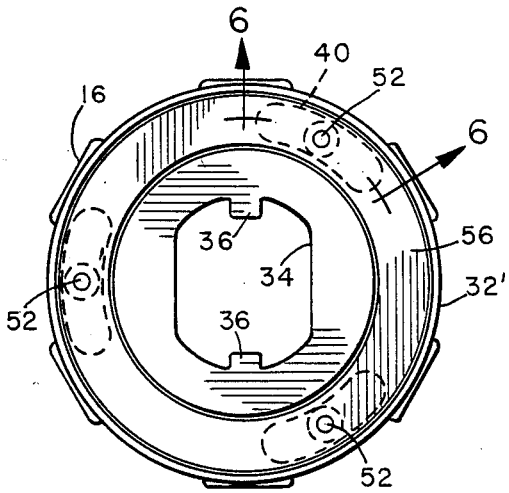
FIG. 5 is a view similar to a portion of FIG. 3, but showing the resilient coupling device of the present invention.
Figure 6:
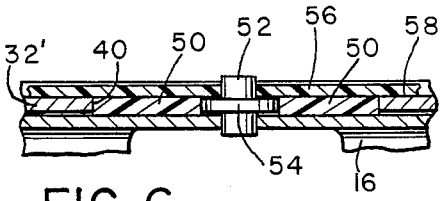
FIG. 6 is an enlarged sectional view taken along line 6—6 of FIG. 5.
Figure 7:
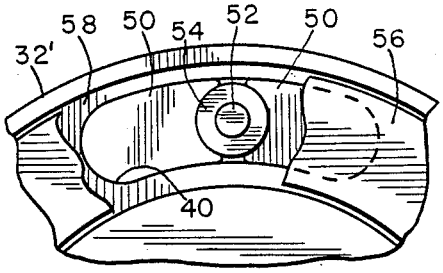
FIG. 7 is a top plan view of the structure of FIG. 6, with the capture ring cut away to reveal the resilient inserts.

The drive ring and resilient drive components of the present invention are shown in the exploded perspective view of FIG. 2 and the front and side view of FIGS. 5–7.

The resilient inserts 50 comprise a flexible material capable of withstanding the long term exposure to diesel fuels and associated additives as well as the temperature of operation. The preferred material comprises a flouroelastomer such as, but not limited to, a flouroelastomer sold by the 3M Company of Minneapolis, Minn. under the name "Fluorel". However other flouroelastomer materials also provide resistance to degradation by diesel fuel at elevated temperatures and are contemplated as within the teaching of the present invention. The use of this type of material allows the material to have an extended life not previously seen in diesel engines.

At the same time, the inserts 50 interact with the drive pins 38 in a manner different from the previous methods and apparatus. As the drive ring 32 rotates, the walls of the slots 40 move the inserts 50 against the drive pins 38. The insert material compresses to some extent but presses against drive pins within the slots 40 and causes the housing 16 to rotate. The compressibility of the material 50 determines the degree of flexibility in the coupling between the drive shaft 30 and the cylindrical enclosure 16. The compression of the inserts 50 exerts a different type of stress on the insert material than exerted on the urethane using the previous tension technique. This greatly increases the life span of the inserts 50 and, therefore, the coupling device.

The inserts 50 are manufactured to occupy substantially all of the volume of the elongated slots 40 not otherwise occupied by the drive pins. The exact dimensions depend on the slot 40 dimensions which are typically on the order of 0.275 inches wide and have an arc length of approximately 0.5 inches each.

In order to connect the governor housing 16 to the drive ring 32' and the inserts 50, special pins 52 are used to replace the former drive pins 38. The pins 52 are secured on one end to the housing 16 using one of several methods. During the initial manufacture of the housing 16 the pins can be secured in place by pressing or spot welding as previously done for the drive pins 38. When the pins 52 are installed during the rebuilding of a governor coupling assembly, the old pins 38 are removed by drilling and the new pins inserted in the drilled holes by pressing. The base of the pins 52 is slightly larger than the drilled holes to assure a tight, strong bond to the housing 16.

The new pins 52, as seen in FIGS. 5 and 6, have an annular ridge or projection 54 which is dimensioned to be slightly smaller than the width of the slots 40 to allow freedom of motion within the slots. The projection 56 decreases the amount of play available for the pins and distributes the forces exerted on the insert material 50.

As seen in FIG. 6, a capture ring 56 is used to confine the inserts 50 within the slots 40. The ring 56 rests within an annular depression 58 on the back surface of the drive ring 32'. The depression 58 allows the ring 56 to rest below or level with the back surface of the drive ring or plate 32' so that it does not interfere with rotation.

The capture ring 56 is secured to the ends of the pins 52 extending through the slots 40 by welding or the like. Again, during initial manufacture this is easily accomplished by spot welding the capture ring in place. When the governor assembly is being rebuilt, the old pins 44 are first drilled out or otherwise removed from the plate 32 and the capture ring 56 then installed over the slots 40.

The capture plate 58, slots 40 and housing 16 form an enclosure that confines the inserts 50. Even if the inserts 50 were damaged or became segmented, no debris can escape to clog fuel pump orifices and the engine would continue to operate normally.

EXAMPLE

As an example of the present invention, a governor coupling device was constructed according to the above principles using a florelastomer material on the order of 0.080 inches thick placed within 3 evenly spaced slots approximately 1.00 by 0.275 inches in size on a 2.75 inch diameter drive plate. The drive ring had a central aperture of about 1.185 inches in diameter and a thickness of about 0.125 inches.

A 0.09 inch thick capture ring having a 1.80 inch inner diameter and 2.60 inch outer diameter was secured within an annular depression on the drive plate. The capture ring was attached to three pins approximately 0.315 inches long which were connected to the governor weight retention housing. The pins had a 0.25 inch diameter annular projection along a 0.075 inch central portion. This assembly was mounted inside of a diesel fuel injector pump housing and connected to an engine which was subsequently driven in excess of 80,000 miles without failure.

What has been described then is a new governor weight retainer coupling device for connection between a drive shaft and a governor weight retention housing in a diesel engine fuel injector pump, that demonstrates an increased life span and resistance to operational failures. This improved coupler device can be incorporated in a fuel injector pump as a new product or retroactively inserted into existing injector pumps without redesign of any existing components.

The foregoing description of a preferred embodiment has been presented for purposes of illustration and description. It is not intended to be exhaustive nor to limit the invention to the precise form disclosed, and many modifications and variations are possible in light of the above teaching. The embodiment was chosen and described to best explain the principles of the invention and its practical application to thereby enable others skilled in the art to best utilize the invention in various embodiments and with various modifications as are suited to the particular use contemplated. It is intended that the scope of the invention be defined by the claims and their equivalents.

What I claim as my invention is:

I claim:

1. A coupling device for use in diesel fuel injector pumps, as used in diesel engine fuel flow regulation and timing, where the pumps have a main housing for confining a plurality of rotary pumps positioned in series along a longitudinal axis and being connected through a drive shaft to a driving source, and having a generally cylindrical weight retention housing positioned adjacent to the rotary pumps with a central opening for passage of the drive shaft therethrough and a series of recesses about its circumference for rotatably supporting a plurality of flyweights which are coupled to a fuel control system, comprising:

an annular drive ring having a central aperture for passage of said drive shaft with at least one key extending therefrom for engaging said shaft, being positioned on said shaft adjacent said governor weight housing with one of two opposing planar surfaces facing said weight retention housing, having a plurality of elongated apertures extending between the opposing surfaces at predetermined radial and angular positions about the ring and an annular depression centrally located between an outer edge and an inner edge on a back surface facing away from said weight retention housing;

a plurality of drive pins, corresponding in number to said elongated apertures being secured on a first end to said weight retention housing and extending through said drive ring elongated apertures, with a second end of said drive pins not extending beyond said back surface, the drive pins having a diameter smaller than a width of the apertures to allow freedom of motion therein;

a plurality of resilient inserts positioned within said elongated apertures immediately adjacent said drive pins so as to occupy substantially all volume not occupied by said pins; and an annular capture ring having an outer and inner diameter corresponding to dimensions for said annular depression in said drive ring, being connected in several locations to said second ends of said drive pins so as to capture said inserts within said elongated apertures.

2. The coupling device of claim 1 wherein said drive ring is on the order of 2.5 inches in diameter, said central aperture is on the order of 1.8 inches in diameter and said elongated apertures are about 0.25 inches in width by 1.00 inches in length.

3. The coupling device of claim 1 wherein said inserts comprise material that is substantially non-reactive with and not degraded by diesel fuels at operating temperatures for said fuel injector pumps.

4. The coupling device of claim 2 wherein said material comprises a flouroelastomer.

5. The coupling device of claim 1 wherein said drive pins further comprise an annular projection at a central position between said first and second ends resting within said elongated apertures.

6. The coupling device of claim 5 wherein the pins are on the order of about 0.30 to 0.35 inches long and have an annular extension centrally located thereon of less than about 0.25 inches diameter.

* * * * *